US008556150B2

(12) United States Patent
Spasov et al.

(10) Patent No.: US 8,556,150 B2
(45) Date of Patent: Oct. 15, 2013

(54) HAND-HELD DRIVE-IN TOOL

(75) Inventors: Robert Spasov, Schaan (LI); Matthias Blessing, Frastanz (AT); Hans Gschwend, Buchs (CH); Ulrich Schiestl, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 1269 days.

(21) Appl. No.: 12/005,107

(22) Filed: Dec. 20, 2007

(65) Prior Publication Data

US 2008/0173689 A1 Jul. 24, 2008

(30) Foreign Application Priority Data

Dec. 22, 2006 (DE) ..... 10 2006 035 304

(51) Int. Cl.
*B25C 1/00* (2006.01)

(52) U.S. Cl.
USPC ..... 227/132; 227/119; 227/121; 227/126; 227/129; 227/131; 227/134; 227/146

(58) Field of Classification Search
USPC ..... 227/132, 110, 119, 121, 126, 129, 131, 227/134, 146
See application file for complete search history.

(56) References Cited

U.S. PATENT DOCUMENTS 1,845,617 A 2/1932 Metcalf
3,810,572 A * 5/1974 Malkin ..... 227/132
3,847,322 A 11/1974 Smith
4,724,992 A * 2/1988 Ohmori ..... 227/146
4,834,278 A * 5/1989 Lin ..... 227/7
5,004,140 A * 4/1991 Fushiya et al. ..... 227/8
5,118,023 A * 6/1992 Fushiya et al. ..... 227/8
5,511,715 A * 4/1996 Crutcher et al. ..... 227/131
5,941,441 A * 8/1999 Ilagan ..... 227/131
7,322,502 B1 * 1/2008 Sun ..... 227/8
7,325,711 B2 * 2/2008 Schiestl et al. ..... 227/131
7,464,844 B2 * 12/2008 Kamins et al. ..... 227/132
7,500,589 B2 * 3/2009 Wolf et al. ..... 227/131
7,513,407 B1 * 4/2009 Chang ..... 227/132
7,516,876 B2 * 4/2009 Ohmori ..... 227/119
7,543,728 B2 * 6/2009 Spasov et al. ..... 227/132
7,559,449 B2 * 7/2009 Viola ..... 227/175.1

OTHER PUBLICATIONS

European Search Report; Apr. 4, 2008; EP 07 12 3112.

* cited by examiner

*Primary Examiner* — Alexandra Elve
*Assistant Examiner* — Michelle Lopez
(74) *Attorney, Agent, or Firm* — Abelman, Frayne & Schwab

(57) ABSTRACT

A hand-held drive-in tool for driving in fastening elements includes a drive-in ram (13), a drive (30) for driving the drive-in ram (13) and having a driving spring member (31) for displacing the drive-in ram (13), a device (70) for preloading the driving spring member (31), a locking device (50) having a locking position (54) in which the locking device (50) retains the driving spring member (31) in its preloaded position and a release position (55) into which the locking device (50) is displaced upon actuation of an actuation switch (19) of the drive-in tool (10), and a mechanical blocking device (60) operating independently of the actuation switch (19) and having an active position (68) in which the blocking device (60) retains the locking device (50) in its locking position (54), and a passive position (69) in which the locking device (50) can be displaced in its release position (55).

5 Claims, 3 Drawing Sheets

HAND-HELD DRIVE-IN TOOL

BACKGROUND OF THE INVENTION

1. Field of the Invention

The present invention relates to a hand-held drive-in tool for driving fastening elements in a constructional component or a workpiece and including a drive-in ram displaceably supported in a guide for driving fastening elements in the constructional component or the workpiece, a drive for driving the drive-in ram and having a driving spring member for displacing the drive-in ram, a device for preloading the driving spring member, a locking device having a locking position in which the locking device retains the driving spring member in its preloaded position and a release position into which the locking device is displaced upon actuation of an actuation switch of the drive-in tool.

2. Description of the Prior Art

The advantage of drive-in tools of the type described above consists in using a low-cost mechanical driving spring member, which permits to economically manufacture this type of drive-in tools.

A drive-in tool of the type described above is disclosed in U.S. Pat. No. 3,847,322. In the disclosed drive-in tool, a drive-in ram is preloaded against a driving spring member by a motor-driven preloading mechanism. A locking device retains the drive-in ram and the driving spring member in the preloaded position. To this end, the locking device has a locking member that lockingly engages a locking surface on the drive-in ram. The locking device is released by an actuation switch, whereby the locking device is lifted off its locking position by a motor-driven mechanism and is displaced in a release position. In the release position of the locking device, the drive-in ram is displaced in the setting direction by the biasing force of the driving spring member for driving a fastening element in a workpiece.

The drawback of the known drive-in tool consists in that at an inadvertent acceleration of the drive-in tool, e.g., when it falls from an elevated position to a relatively low position, the locking device can inadvertently be displaced into its release position.

Accordingly, an object of the present invention is a drive-in tool in which the above-discussed drawback a known drive-in tool is eliminated.

SUMMARY OF THE INVENTION

This and other objects of the present invention, which will become apparent hereinafter, are achieved by providing a blocking device operating independently of the actuation switch and having an active position in which the blocking device retains the locking device in its locking position and a passive position in which the locking device can be displaced in its release position.

The blocking device insures that no inadvertent actuation of the locking device, e.g., as a result of an impact or another inadvertent action, can take place. The blocking device further insures that the setting process cannot be actuated as a result of malfunction of the control electronics.

Advantageously, the locking device has a counter element and the blocking device has at least one blocking element for blocking the counter element and connectable with the press-on filler that detects when the drive-in tool is pressed against a workpiece. Thereby, the blocking device can reveal whether the drive-in tool is properly pressed against the workpiece. The blocking device also permits to ascertain whether the user is ready to initiate a drive-in process, and if the drive-in tool is in a setting-ready condition.

Advantageously, the blocking device has at least one blocking element connected with a mechanical detection element, which detects presence of a power source in the power source receptacle of the drive-in tool, for blocking a counter element of the locking device in the absence of the power source in the tool power source receptacle.

Thereby, the blocking device can reveal if a power source, an accumulator or a battery, is located in the power source receptacle of the drive-in tool. Further, the blocking device prevents actuation of a drive-in process when no power source is present in the power source receptacle of the tool.

It is advantageous when the blocking device has at least two blocking elements and the locking device has counter elements and at least, one of the at least two blocking elements occupies a position in which it blocks an associated counter element for retaining the locking device in its locking position. In order to displace the mechanical blocking device in its passive position so that the locking device can be displaced in its release position with an actuation switch, all of the blocking elements should be displaced in a position in which they do not block any of the counter elements of the locking device.

Advantageously, there is provided spring means for biasing the at least one of the at least two blocking elements into the position in which it blocks the respective counter element. Thereby, the mechanical blocking device is always automatically displaced into its active position, e.g., when the drive-in tool is lifted off a workpiece, or when the power source, an accumulator or a batter, is removed from the power source receptacle of the drive-in tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
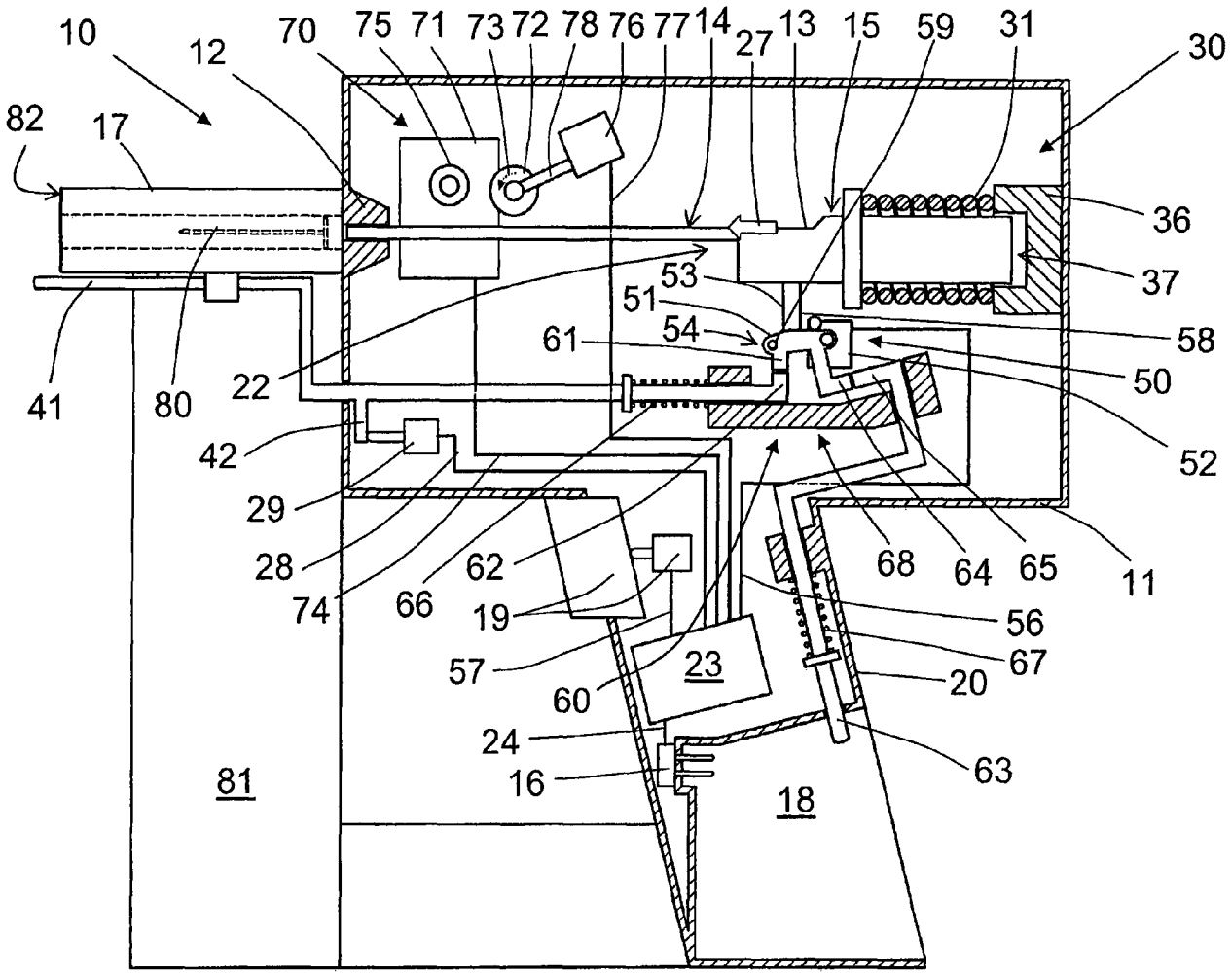
FIG. 1 a longitudinal cross-sectional view of a drive-in tool according to the present invention in a preloaded position of the driving spring member with a power source being removed from the receptacle.

A drive-in tool 10 according to the present invention, which is shown in FIG. 1, includes a housing 11 and a drive generally designated with a reference numeral 30 and arranged in the housing 11. The drive 30 drives a drive-in ram 13 displaceable in a guide 12 likewise located in the housing 11. The drive-in ram 13 has a drive-in section 14 for driving a fastening element 80 and a head section 15.

A bolt guide 17, which is arranged coaxially with the guide 12, adjoins the guide 12 at the end of the guide 12 facing in the drive-in direction 27. A magazine 81, in which fastening elements 80 are stored, projects sidewise from the bolt guide 17.

The drive 30 includes a driving spring member 31 which is indirectly supported against the housing 11 at a support location 36 at one of its ends and which engages the head section 15 of the drive-in ram 13 with another of its end. The driving spring member can be formed, e.g., as a composite spring or as a steel spring and is formed as e.g., a helical spring.

In its loaded condition 22, which is shown in FIG. 1, the drive-in ram 13 is preloaded against the driving spring member 31 and has its head section 15 inserted in a cylindrical guide space 37 defined by the driving spring member 31 and the support location 36 for the driving spring member 31. The possibility to displace the head section 15 in the guide space 37 within the means defining the support location and, in particular, within the driving spring member 31 permits to obtain advantageously a compact construction.

In the loaded position 22, the drive-in ram 13 is retained by a locking device generally designated with a reference numeral 50. The locking device 50 has a locking member 51, e.g., a pawl that engages, in a locking position 54 (see FIGS. 1 and 2), a locking member 59 formed as a pin and provided on a locking surface 53 of a projection 58 of the drive-in ram 13, retaining the drive-in ram 13 against the biasing force of the driving spring member 31. The locking member 51 is supported on a shaft 49 of a servo motor 52. The servo motor 52 displaces the locking member 51 into a release position 55 shown in FIG. 3 (the locking member 51 is shown with dash lines), as it will be described below. The servo motor 52 is connected with a control unit 23 by a first electrical control conductor 56.

The drive-in tool 10 is provided with a blocking device generally designated with a reference numeral 60 which operates independent from an actuation switch and has a first blocking element 62 and a second blocking element 65, and which retains the locking device 50 in its locking position 54. The mechanical blocking device 60 is switchable between an active position 68 and a passive position 69. The mechanical blocking device 60 retains, in its active position 68, the locking device 50 in its locking position 54. The locking device 50 is displaced in its release position 55 when the blocking device 60 is in its passive position 69.

The first blocking element 62 of the blocking device 60 is connected with a mechanical press-on feeler 41 that detects pressing of a muzzle 82 of the drive-in tool 10 against a workpiece U. The press-on feeler 41 is formed to this end as a control rod and is displaceable over the bolt guide 17, being guided in the housing 11 of the drive-in tool 10. In a non-pressed condition of the drive-in tool 10, a free end of the press-on feeler 41 extends beyond the muzzle 82 of the drive-in tool 10 (see FIG. 1). The press-on feeler 41 is resiliently biased into its position, in which it projects beyond the muzzle 82, by a first spring 66. In this non-press-on position of the drive-in tool 10, the first blocking element 62, which is located on the opposite end of the press-on feeler 41, is located directly opposite a first counter element 61 of the locking member 51 and, thereby, blocks the pivotal movement of the locking member 51 into its release position 55.

The second blocking element 65 is connected with a mechanical detection element 63 that detects presence of a power source 21 such as, e.g., accumulator or battery package, in a receptacle 18 of the drive-in tool 10. The detection element is formed as a control rod displaceable in the housing 11 of the drive-in tool 10. When no power source 21 is present in the receptacle 18, the free end of the detection element 63 projects into the receptacle 18 (see FIG. 1). A second spring 67 biases the detection element 63 in the direction of its position in which it projects into receptacle 18. In the projecting position of the detection element 63, the second blocking element 65, which is located at the opposite end of the detection element 23, is located directly opposite a second counter element 64 of the locking member 51, thereby blocking the pivotal movement of the locking member 51 into its release position 55.

The blocking device 60 is always in its active position 68 when at least one of its blocking elements 62, 65 blocks the pivotal movement of the locking member 51 into its release position 55.

Figure 2:
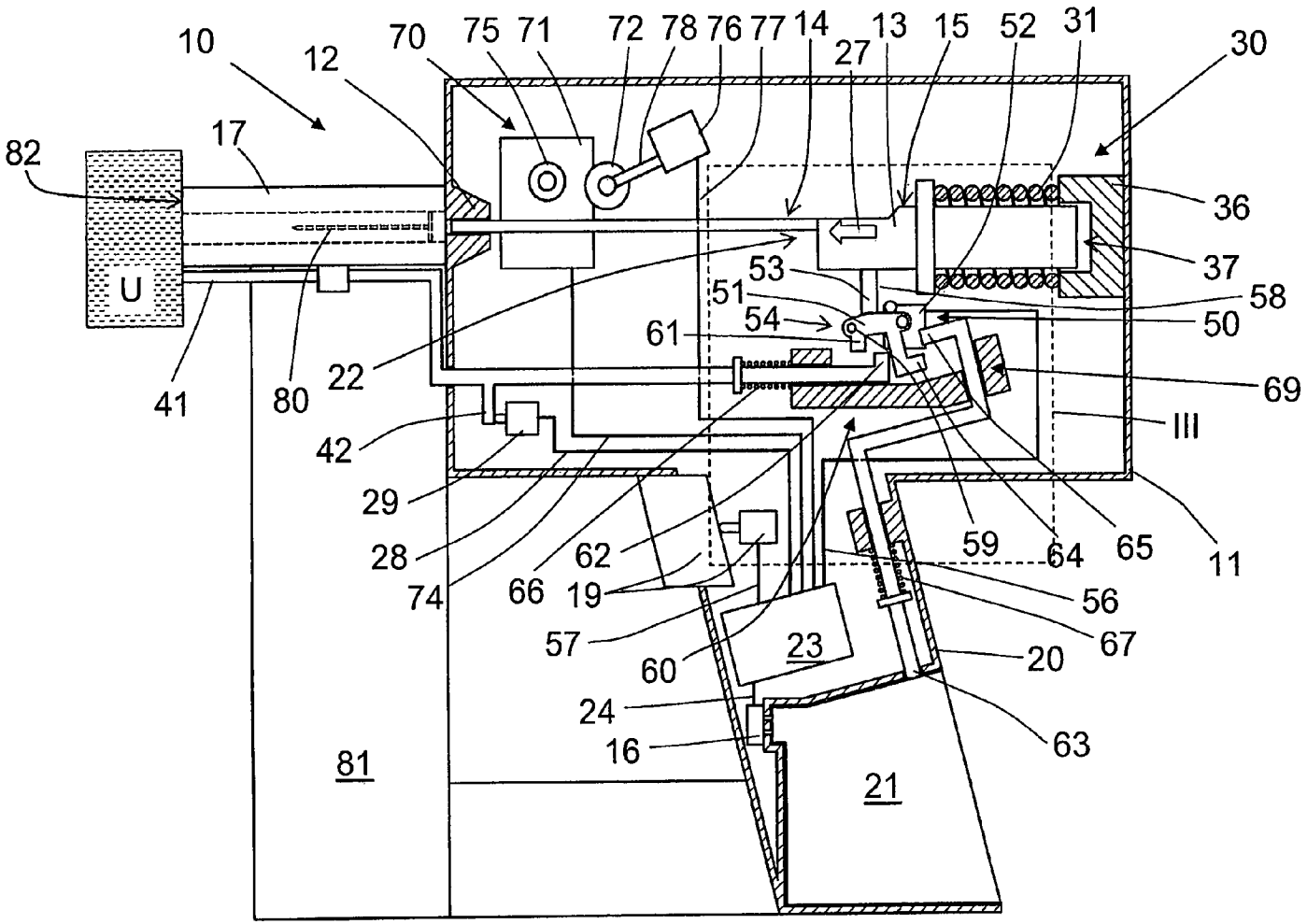
FIG. 2 a view similar to that of FIG. 1, with the drive-in tool being pressed against a workpiece.
Figure 3:
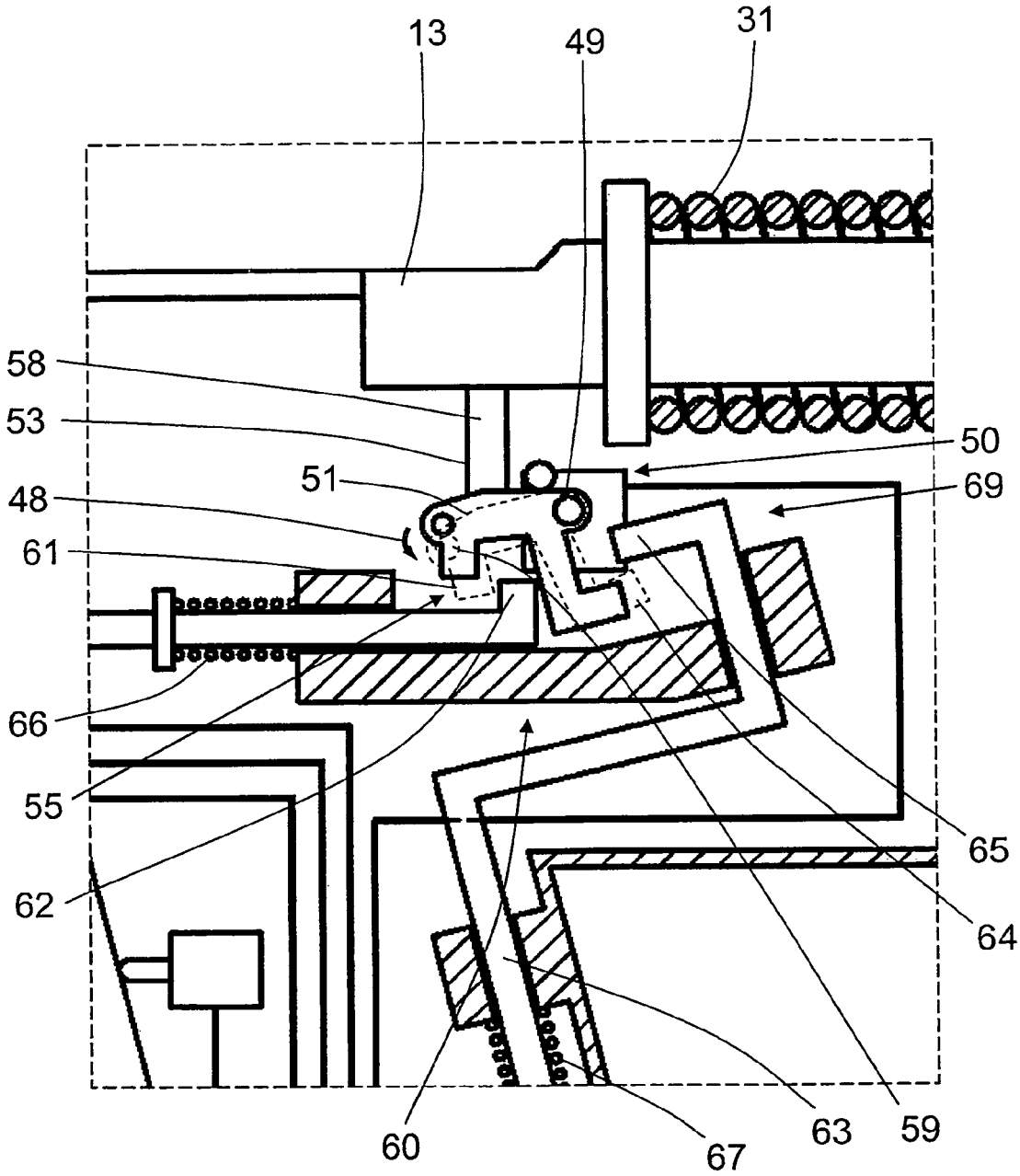
FIG. 3 a detail of the drive-in tool showing the portion III in FIG. 2.

The drive-in tool 10 has a handle 20 on which an actuation switch 19 for actuating a drive-in process with the drive-in tool is arranged. The receptacle 18 for receiving a network-dependent power source 21 (see FIG. 2) is provided in the handle 20. The power source 21 supplies the drive-in tool 10 with the electrical energy. In the disclosed embodiment, the power source 21 has at least one accumulator which is inserted, as shown in FIG. 2, in the receptacle 18. The power source 21 or the at least one accumulator is connected with the control unit 23 over a contact element 16 provided on the receptacle 18, and a supply conductor 24. A switching conductor 57 connects the control unit 23 with the actuation switch 19.

The press-on feeler 41 cooperates with an electrical switch 29 with which it is connected by a switching member 42. The electrical switch 29 is connected with the control unit 23 by a switching conductor 28. The switch 29 communicates an electrical signal to the control unit 23 as soon as the drive-in tool 10 is pressed again the workpiece U, as shown in FIG. 2. Thereby, the switch 29 insures that the control unit 23 initiates a setting process with the drive-in tool 10 only then when the drive-in tool 10 is properly pressed against the workpiece U.

The drive-in tool 10 further has a tensioning or preloading device, which is generally designated, with a reference numeral 70. The preloading device 70 has a motor 71 for driving a drive roller 72. A second control conductor 74 electrically connects the motor 71 with the control unit 23 that actuates the motor 71 when, e.g., the drive-in ram 13 is located in its end position in the drive-in direction 27 or when the drive-in tool 10 is lifted off the workpiece U. The motor 71 has an output member 75 such as a driven gear which is connectable with the drive roller 72. The drive roller 72 is supported rotatably on a longitudinally adjustable control arm 78 of an adjustment element 76 formed as a solenoid. The adjustment element 76 is connected with the control unit 23 by an adjustment conductor 77. During an operation, the drive roller 72 is connected with the output member 75 that rotates the drive roller 72 in the direction of arrow 73 shown with dash lines. The drive roller 72 frictionally engages the drive-in ram 13 for displacing the same. Naturally, another suitable design of the preloading device 70 is possible.

When the drive-in tool 10 is actuated by a main switch, not shown, the control unit 3 firstly ascertains that the drive-in ram 13 is located in its initial position shown in FIG. 1. If this is not the case, then the adjustment element 76 displaces the drive roller 72 into engagement with the output member 75 driven by the motor 71. Simultaneously, the drive roller 72 engages the drive-in ram 13 which is displaceable by the drive roller 72 rotatable in the direction of arrow 73, in the direction of the drive 30. This preloads the driving spring member 31 of the drive 30. When the drive-in ram 13 and the driving spring member 31 reach their preloaded or initial position 22, the locking member 51 of the locking device 50 engages the locking surface 53 of the drive-in ram 13, retaining the drive-in ram in the initial position 22. As soon as this occurs, the control unit 23 turns the motor 71 off, and the adjustment element 76 which is controlled by the control unit 23, displaces the drive roller 72 from its position in which it engages the output element 75 and the drive-in ram 13, into its disengagement position.

In FIG. 2, the power source 21 is present in the receptacle 18, and the detection element 63 is displaced so that the second blocking element 65, which is connected with the detection element 63, is displaced from its position shown in FIG. 1, in which it is located opposite the second counter element 64 of the locking member 51, away when the drive-in tool 10 is pressed against the workpiece U, as shown in FIG. 2, the switch 29 sets the control unit 23 in a setting-ready position. The press-on filler 41 is displaced toward the drive-in tool 10, whereby the first blocking element 62 is displaced from its position opposite the first counter element 61 of the locking member 51, shown in FIG. 1, away. The blocking device 60 is now in its passive position (which can also be seen in FIG. 3), in which the locking member 51 can be displaced into its release position 55.

Upon actuation of the actuation switch 19 by the user, the control unit 23 displaces the locking device 50 in its release position 55 in which the locking member 51 is lifted off the locking surface 53 on the drive in ram 13 by the servo motor 52. Upon lifting of the locking member 51 off, the driving spring member 31 of the drive 30 displaces the drive-in ram 13 in the drive-in direction 27, whereby the fastening element 80 is driven in the workpiece U.

For returning the drive-in ram 13 and for preloading the driving spring member 31, at the end of the drive-in process, the preloading device 70 is actuated by the control unit 23, preferably, before the drive-in tool 10 is lifted off the workpiece U again. The preloading device 70 displaces the drive-in ram 13 in the above described manner against the driving spring member 31 of the drive 30, preloading the driving spring member 31. The drive-in ram 13 displaces the driving spring member 31 until the locking member 51 is displaced again into its locking position in which it engages the locking surface 53 on the drive-in ram 13. To this end, the locking member 51 can be spring-biased in the direction of the drive-in ram 13.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held drive-in tool for driving in fastening elements, comprising a guide (12); a drive-in ram (13) displaceably supported in the guide (12); a drive (30) for driving the drive-in ram (13) and having a driving spring member (31) for displacing the drive-in ram (13); a device (70) for preloading the driving spring member (31); a locking device (50) having a locking position (54) in which the locking device (50) retains the driving spring member (31) in a preloaded position thereof, and a release position (55) into which the locking device (50) is displaced upon actuation of an actuation switch (19) of the drive-in tool (10); and a mechanical blocking device (60) operating independently of the actuation switch (19) and having an active position (68) in which the blocking device (60) retains the locking device (50) in the locking position thereof (54), and a passive position (69) in which the locking device (50) can be displaced in the release position thereof (55).

2. A drive-in tool according to claim 1 further comprising a mechanical press-on feeler (41), wherein the locking device (50) comprises a counter element (51), and wherein the blocking device (60) has at least one blocking element (62) for blocking the counter element (61) and connectable with the press-on filler (41).

3. A drive-in tool according to claim 1, comprising a mechanical detection element (63) for detecting a power source (21) wherein the locking device (50) has a counter element (64), and wherein the blocking device (60) has at least one blocking element (65) connected with the mechanical detection element (63) for blocking the counter element (64).

4. A drive-in tool according to claim 1, wherein the blocking device (60) has at least two blocking elements (62, 65), and the locking device (50) has counter elements (61, 64), and wherein at least, one of the at least two blocking elements (62, 65) occupies a position in which it blocks an associated counter element (61, 64) for retaining the locking device (50) in the locking position (54) thereof.

5. A drive-in tool according to claim 4, comprising spring means (66, 67) for biasing the at least one of the at least two blocking elements (62, 65) into the position in which it blocks the respective counter element (61, 64).

* * * * *